US008814007B2

(12) United States Patent
Mills

(10) Patent No.: US 8,814,007 B2
(45) Date of Patent: Aug. 26, 2014

(54) DISPENSER WITH DIRECTIONAL FLOW CONTROLLING FLANGE AND CORRESPONDING SYSTEMS

(75) Inventor: Andrew J. Mills, Highland Park, IL (US)

(73) Assignee: Medline Industries, Inc., Mundelein, IL (US)

( * ) Notice: Subject to any disclaimer, the term of this patent is extended or adjusted under 35 U.S.C. 154(b) by 485 days.

(21) Appl. No.: 12/983,074

(22) Filed: Dec. 31, 2010

(65) Prior Publication Data

US 2012/0168466 A1 Jul. 5, 2012

(51) Int. Cl.
*B65D 88/54* (2006.01)

(52) U.S. Cl.
USPC ..... 222/321.7; 222/383.1; 222/153.1; 222/571

(58) Field of Classification Search
USPC ..... 222/135, 142.7, 153.13, 321.1, 207, 222/321.7, 372, 383.1, 384, 566, 567, 568, 222/575, 383.3, 322, 321.6, 320, 321.8, 222/562, 477, 478, 484, 481, 270, 571, 222/321.3–321.9, 373, 378, 631, 635, 401, 222/153.01, 153.11, 182
See application file for complete search history.

(56) References Cited

U.S. PATENT DOCUMENTS

| | | | | |
|---|---|---|---|---|
| D247,499 | S | 3/1978 | Kearney | |
| D267,454 | S | 1/1983 | Fine | |
| 4,436,225 | A * | 3/1984 | Libit | 222/207 |
| D274,499 | S | 7/1984 | Soos | |
| D309,256 | S | 7/1990 | Boesel | |
| D309,356 | S | 7/1990 | Johns | |
| 5,297,704 | A | 3/1994 | Stollmeyer | |
| 5,301,850 | A | 4/1994 | Gueret | |
| 5,615,806 | A * | 4/1997 | Grothoff | 222/153.13 |
| 5,632,418 | A | 5/1997 | Brown | |
| D454,308 | S | 3/2002 | Scheida | |
| 6,357,629 | B1 * | 3/2002 | Ding | 222/153.13 |
| 6,533,144 | B2 * | 3/2003 | Davies et al. | 222/153.13 |
| D527,258 | S | 8/2006 | Crawford | |

(Continued)

FOREIGN PATENT DOCUMENTS

| | | |
|---|---|---|
| EM | 000185491-0001 | 8/2004 |
| EM | 00064858-0001 | 1/2007 |
| EM | 000645858-0001 | 1/2007 |
| EM | 000649082-0003 | 1/2009 |
| GB | D2026494 | 2/1993 |
| GB | D2039088 | 8/1994 |

OTHER PUBLICATIONS

Vinson, Brian N., "Notice of Allowance", U.S. Appl. No. 29/382,325, filed Dec. 31, 2010; Mailed Dec. 19, 2011.

(Continued)

*Primary Examiner* — Frederick C Nicolas
*Assistant Examiner* — Bob Zadeh
(74) *Attorney, Agent, or Firm* — David Noskowicz; Philip H. Burrus, IV

(57) ABSTRACT

A dispenser (300) includes an arched flange (303) that works as a baffle to prevent dispensed media from exiting a nozzle erratically. The dispenser (300) can be configured with a connector (402), connector extension (403), and nozzle (401) for use with vessels (802). Alternatively, a dispenser cap (1100) can include a coupling mechanism (1200) configured to attach to prior art dispensers. Dispensed media is directed along the dispensing surface (301) in a ventral direction (302) relative to the dispenser (300), thereby eliminating the possibility of the media being dispensed into the user's face or eyes, regardless of clogs present or user hand position.

16 Claims, 7 Drawing Sheets

(56) References Cited

U.S. PATENT DOCUMENTS

| | | | | |
|---|---|---|---|---|
| 7,100,841 | B2 * | 9/2006 | Ivey et al. | 239/136 |
| D571,216 | S | 6/2008 | Christian et al. | |
| D595,132 | S | 6/2009 | Tseng | |
| D600,553 | S | 9/2009 | Dubitsky et al. | |
| D601,422 | S | 10/2009 | Benavidez et al. | |
| D613,613 | S | 4/2010 | Llewellyn et al. | |
| D625,944 | S | 10/2010 | Yang et al. | |
| D628,481 | S | 12/2010 | Maddy | |
| 7,857,172 | B2 | 12/2010 | Harvey | |
| D635,808 | S | 4/2011 | DeBretton Gordon | |
| D636,262 | S | 4/2011 | Michitsuji et al. | |
| D642,917 | S | 8/2011 | Mills | |
| 8,403,181 | B2 * | 3/2013 | Ding | 222/153.13 |
| 2008/0264974 | A1 | 10/2008 | Binderbauer et al. | |
| 2009/0108023 | A1 * | 4/2009 | Houghton et al. | 222/153.13 |
| 2009/0188947 | A1 | 7/2009 | Dodd | |
| 2009/0236254 | A1 | 9/2009 | Jenkins et al. | |
| 2009/0261123 | A1 * | 10/2009 | McNiff et al. | 222/39 |
| 2010/0288794 | A1 * | 11/2010 | Chapin | 222/377 |

OTHER PUBLICATIONS

Vinson, Brian N., "Notice of Allowance", U.S. Appl. No. 29/382,324, filed Dec. 31, 2010; Mailed Dec. 27, 2011.

Vinson, Brian N., "Restriction Requirement", U.S. Appl. No. 29/414,938, filed Mar. 6, 2012; Mailed Apr. 18, 2012.

Vinson, Brian "Restriction Requirement", U.S. Appl. No. 29/414,935, filed Mar. 6, 2012; Mailed Apr. 30, 2012.

Tuttle, Catherine A., "Restriction Requirement", U.S. Appl. No. 29/396,948, filed Jul. 8, 2011; Mailed Jul. 3, 2012.

Tuttle, Catherine A., "Ex parte Quayle Action", U.S. Appl. No. 29/382,322, filed Dec. 31, 2010, Mailed May 6, 2011.

Tuttle, Catherine A., "Notice of Allowance", U.S. Appl. No. 29/382,322, filed Dec. 31, 2010; Mailed Jun. 14, 2011.

Tuttle, Catherine "Notice of Allowance", U.S. Appl. No. 29/391,074, filed May 3, 2011; Mailed Jun. 22, 2011.

Zadeh, Bob "Notice of Allowance", U.S. Appl. No. 13/951,779; Filed Jul. 26, 2013; Mailed Nov. 6, 2013.

Zadeh, Bob "Final OA", U.S. Appl. No. 13/951,779; Filed Jul. 26, 2013; Mailed Apr. 22, 2014.

* cited by examiner

DISPENSER WITH DIRECTIONAL FLOW CONTROLLING FLANGE AND CORRESPONDING SYSTEMS

BACKGROUND

1. Technical Field

This invention relates generally to dispensing systems, and more particularly to a dispenser for a dispensing system.

2. Background Art

Pump type bottles are used for dispensing liquid and gel media, such as soaps, lotions, and other substances. This type of dispenser system is widely used in washrooms, bathrooms, kitchens, and so forth. With a pump-type bottle, a user generally pushes a plunger or squeezes a lever, thereby causing a liquid or gel substance disposed within a container coupled to the dispenser to be guided through and dispensed from a chamber in the dispenser. When the chamber is clogged, dispensation of the substance within the bottle can be compromised.

Figure 2:
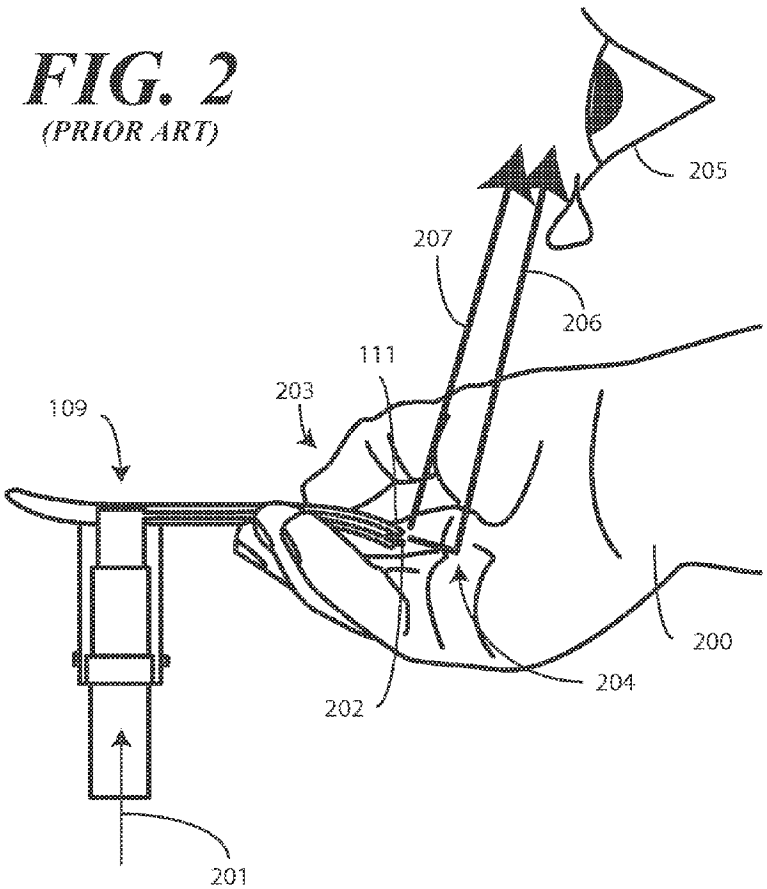
FIG. 2 (PRIOR ART)
FIG. 2 illustrates a prior art pump in use.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF EMBODIMENTS OF THE INVENTION

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Figure 1:
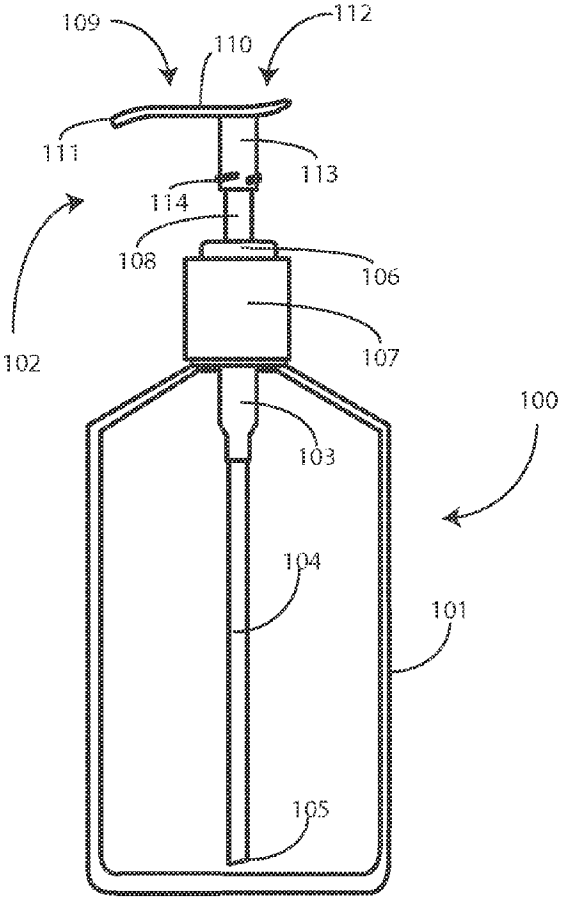
FIG. 1 (PRIOR ART)
FIG. 1 illustrates a prior art pump dispenser.

Beginning with FIG. 1, illustrated therein is a prior art dispenser 100 employing a pump mechanism assembly 102. Such a dispenser is shown and described in U.S. Published Patent Application No. 2009/0108023 to Houghton et al. As shown in FIG. 1, the dispenser 100 includes a bottle or container 101, which can be made of a transparent material. The pump mechanism assembly 102 sits on a neck opening of the container 101. The pump mechanism assembly 102 can be threaded onto the neck opening so that it is securely retained to the container 101.

A displacement pump 103 extends from a dip tube 104. The bottom 105 of the dip tube 104 can be cut on an angle or bias in order to ensure maximum retrieval of the media disposed within the container 101. A collar 106 is positioned at the top of a cap 107. A hollow pump shaft 108 extends through the pump mechanism assembly 102. A pump head assembly 109 is connected the hollow pump shaft 108.

A pump top 110 typically includes a nozzle 111 having a nozzle orifice at the extreme end. An actuator surface 112 is provided for engagement by a user's finger, thumb, or hand. The user pushes downward on the actuator surface 112 to dispense the media disposed within the container 101. A neck 113 extends downward from the pump top 110. The neck 113 can include threads 114 adapted to mate with threads disposed within the collar 106. The threads 114 can be used to prevent pump operation during shipment, transport, or periods of non-use.

The Houghton application then identifies a long felt need. Specifically, Houghton states, "Presently, many antimicrobial solutions are alcohol based and include a polymeric thickener such as a carbomer, increasing the viscosity of the solution into a gelatinous fluid. After a dispensing operation, the residual of the solution that remains at the dispensing orifice often coagulates or tends to harden because of the presence of the polymeric thickener and the evaporation of the water and alcohol components of the solution. When this happens, the output orifice of the dispenser clogs to some degree, changing the orifice geometry, defining a deflection area at the orifice, and generally changing the projection of solution emitted therefrom. As a consequence, the dispensing of such solutions from a standard dispenser nozzle often result in misdirection of the dispensed material. Moreover . . . any resultant misdirection of the solution could cause the solution to be dispensed upon the user's clothing, face, or other body parts, rather than the hand, as intended. The results are simply unsatisfactory. Misdirection of solution that reaches other than the user's hand is certainly not appreciated by the user. Moreover, in previously known dispensers, the actual clog or coagulated material has a displeasing appearance, inconsistent with the cleanliness and sanitation intended by the solution itself." Houghton articulates the long felt need found in the industry in the following manner: "There is a need in the art for a pump head for use with a displacement pump and a bottle dispenser, that may be used with solutions having a tendency to clog or coagulate in the dispensing nozzle, that is configured such as to control or limit any misdirection of dispensing resulting from the coagulation." Houghton then describes his device as providing a solution to the dispensing misdirection issue.

Applicant's testing has shown that the long felt need of controlling dispensing misdirection still exists. Turning now to FIG. 2, illustrated therein is a sectional view of the pump head assembly 109 taught by Houghton. As shown, a user 200 is employing the pump head assembly 109 of Houghton to dispense an alcoholized media 201. As noted by Houghton, clogs 202 typically form at the nozzle 111. Applicant's experimental testing has shown that when the user 200 employs the pump head assembly 109 with a "thumbs up" hand 203, the dispensation of the alcoholized media 201 can be so erratic about the clog 202 that the media 206 is directed away from the intended target for landing the media. Often, the media is directed away from the user's hand 203 completely and thus misses the user's hand 203. The media may glance 204 off the user's hand 203 into the user's face, or worse, into the user's eye 205. Further, despite Houghton's downwardly pointing nozzle 111, depending upon the user's position relative to the pump head assembly 109, such as may occur when the pump head assembly 109 is on a table and the user 200 is sitting, media 207 can be dispensed directly into the user's face or eye 205.

Accordingly, there is not only a long felt need to solve misdirection during dispensation, but there have also been unsuccessful attempts by those of ordinary skill in the art to solve this problem. Turning now to FIGS. 3-7, illustrated therein is dispenser 300 configured in accordance with one or more embodiments of the present invention that solves this long felt need. The dispenser 300 may be manufactured from an injection molding or other process from thermoplastic materials or silicone. The thermoplastic materials or silicone can be configured to be clear or opaque, and can include one or more colors or printing disposed thereon.

As shown in FIGS. 3-7, the dispenser 300 includes a dispensing surface 301 that is configured as an arched flange 303. The arched flange 303 can be manufactured by forming a flat surface in an initial mold and then pressure forming the curvature in a secondary operation.

Figure 3:
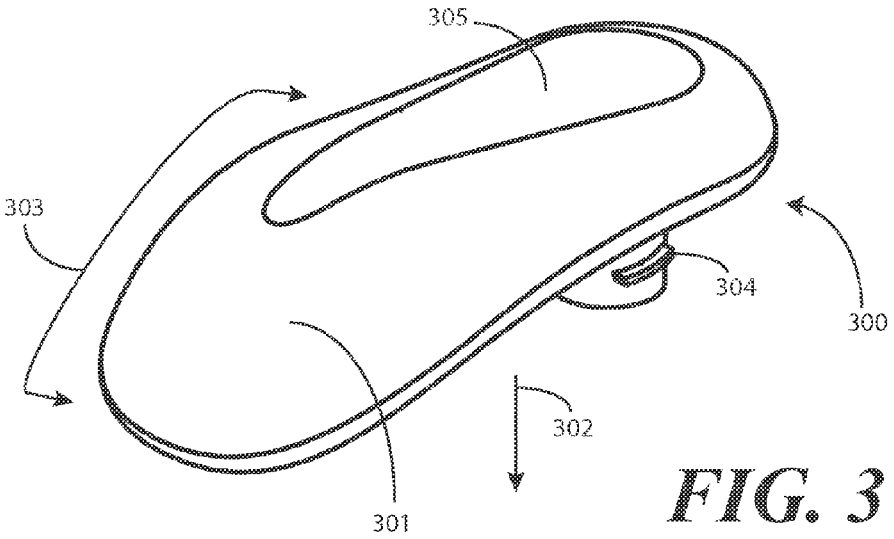
FIG. 3 illustrates one dispenser configured in accordance with embodiments of the invention.
Figure 4:
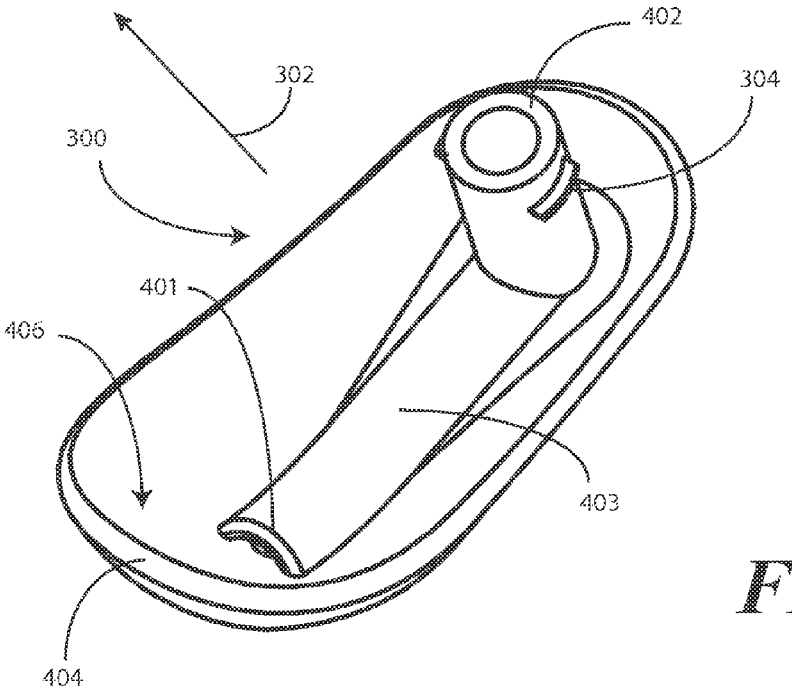
FIG. 4 illustrates one dispenser configured in accordance with embodiments of the invention.

In the perspective view of FIGS. 3 and 4, the arched flange 303 provides a scalloped or half-clamshell hood about the nozzle 401. Accordingly, when media is dispensed from the nozzle 401, a user is assured that—despite the size, shape, or density of any clog that might be present—the media will not be directed towards the face or eye. This is true because the arched flange includes a concave surface 406 that functions as a media baffle preventing dorsal dispensation of media. The baffling function of the concave surface forces media to be dispensed ventrally 302 from the dispenser 300.

In the illustrative embodiment of FIGS. 3-7, the dispenser 300 includes a connector 402 that is configured for attachment to a pump stem, pump chamber, or other dip tube extending from a media vessel. The connector 402 is illustratively shown has having a cylindrical cross section. However, those of ordinary skill in the art having the benefit of this disclosure will understand that embodiments described herein are not so limited, as the cross section could be square, rectangular, triangular, hexagonal, or other shapes as well.

A chamber extension 403 extends from the connector 402. In one embodiment, the chamber extension 403 passes along a portion of the arched flange 303 and terminates at the nozzle 401. The nozzle 401 can be configured with a partially circular (or otherwise rounded) cross section with the arched flange 303 closing one side of the partially circular (or otherwise rounded) cross section.

In one or more embodiments, the chamber extension 403 terminates at a location that is short of a terminating edge 404 of the arched flange. For example, in the illustrative embodiment of FIGS. 3-7, the arched flange 303 extends from a plane 701 defined by the planar top portion 305 a distance of three-quarters of an inch and one inch, with the chamber extension 403 passing along between fifty and seventy-five percent of the arched flange 303. Accordingly, a length 601 of the concave surface 406 is present between the nozzle 401 and the terminating edge 404 to serve as the baffle. In one or more embodiments, this length 601 of the baffle is between 0.25 inches and 0.75 inches. In the illustrative embodiment of FIGS. 3-7, this length 601 is about 0.5 inches. The baffle causes dispensed media exiting the nozzle 311 to be directed along the underside concave surface of the arched flange 303 ventrally 302 away from the dispensing surface 301.

In one embodiment the surface of the baffle may have a smooth surface portion that is substantially untextured. The smooth surface portion reduces the adhesive potential of the media to the baffle surface. The smooth surface portion is adjacent the nozzle 401, including at least a portion of the surface between the nozzle 401 and the termination edge 404.

In one or more embodiments, the connector 402 includes retention mechanisms 304. The retention mechanisms 304 can be configured as threads, protrusions, latch members, or as other retention components. The retention mechanisms 304 can be used to retain the dispenser 300 in a pump chamber of a pump vessel (such as that shown in FIGS. 8 and 9) when the dispenser 300 is not in use.

Figure 5:
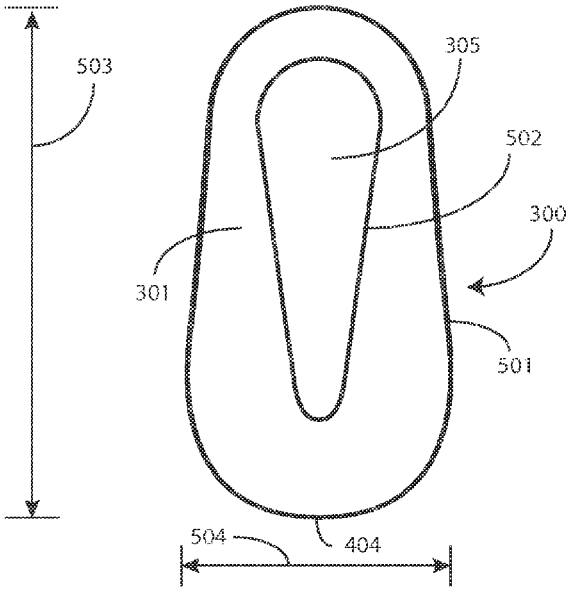
FIG. 5 illustrates one dispenser configured in accordance with embodiments of the invention.
Figure 6:
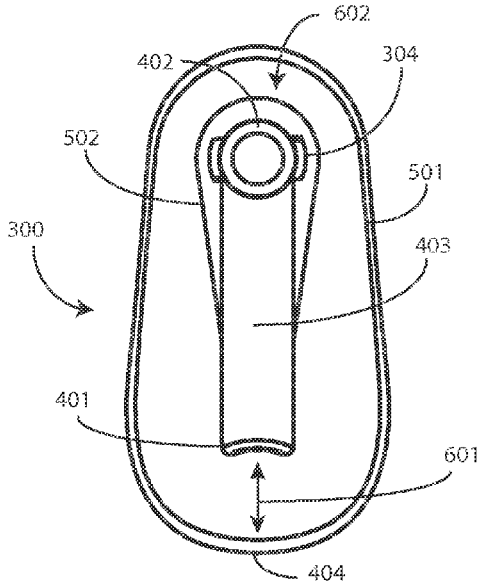
FIG. 6 illustrates one dispenser configured in accordance with embodiments of the invention.
Figure 7:
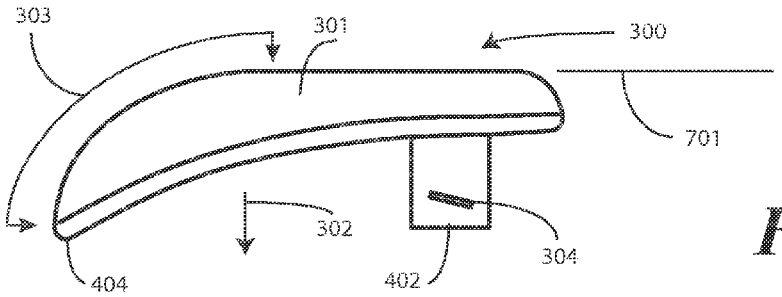
FIG. 7 illustrates one dispenser configured in accordance with embodiments of the invention.

As shown in the plan views of FIGS. 5 and 6, in one embodiment the dispenser 300 can be configured with a tapering contour perimeter 501. When viewed in plan view, this tapering contour perimeter 501 defines a teardrop. In other embodiments, other configurations may be employed while not departing from the spirit of the invention. For example, rectangular, ovular or other shapes may be substituted for the teardrop.

In one embodiment, the dispensing surface 301 can also include a planar top portion 305. The planar top portion 305 includes both ornamental considerations and functional considerations. The planar top portion 305 can provide a positive platform against which a user may press the dispensing surface 301. Additionally, the planar top portion 305 can provide an aesthetically pleasing appearance as well. In the illustrative views of FIGS. 3-7, the planar top portion 305 is configured as a reduced teardrop 502 when viewed in plan view. In this illustrative embodiment, the reduced teardrop 502 is oriented 180 degrees out of phase relative to the tapering contour perimeter 501. As shown in the bottom plan view of FIG. 6, in one embodiment the connector 402 can be disposed within a belly 602 of the reduced teardrop 502.

It will be clear to those of ordinary skill in the art having the benefit of this disclosure that the dispenser 300 can be scaled to any of a variety of sizes based upon application. For instance, in large-scale operations, such as dispensing axel grease for automotive maintenance, the dispenser 300 can be quite large. By contrast, in sensitive operations such as dispensing alcoholized disinfectants onto small surgical instruments, the dispenser 300 can be quite small. The illustrative embodiment shown in FIGS. 3-7 is scaled so as to be suitable for personal use, such as in the dispensation of alcoholized hand sanitizers or medical gels. Accordingly, the dispenser 300 has a length 503 of between two and three inches wide, and in one embodiment is about 2.44 inches long. The dispenser 300 has a width 504 of between one inch and one and a half inches, and in one embodiment is about 1.25 inches.

Figure 8:
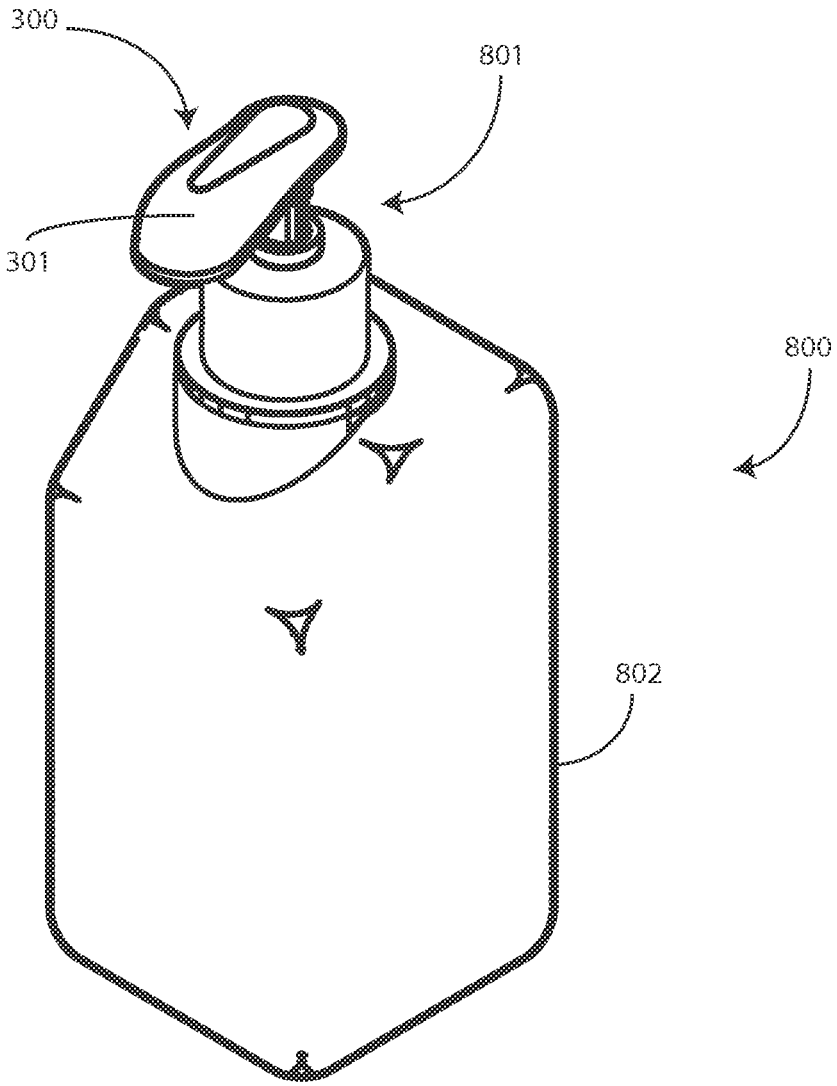
FIG. 8 illustrates one pump dispenser vessel employing a dispenser configured in accordance with embodiments of the invention.
Figure 9:
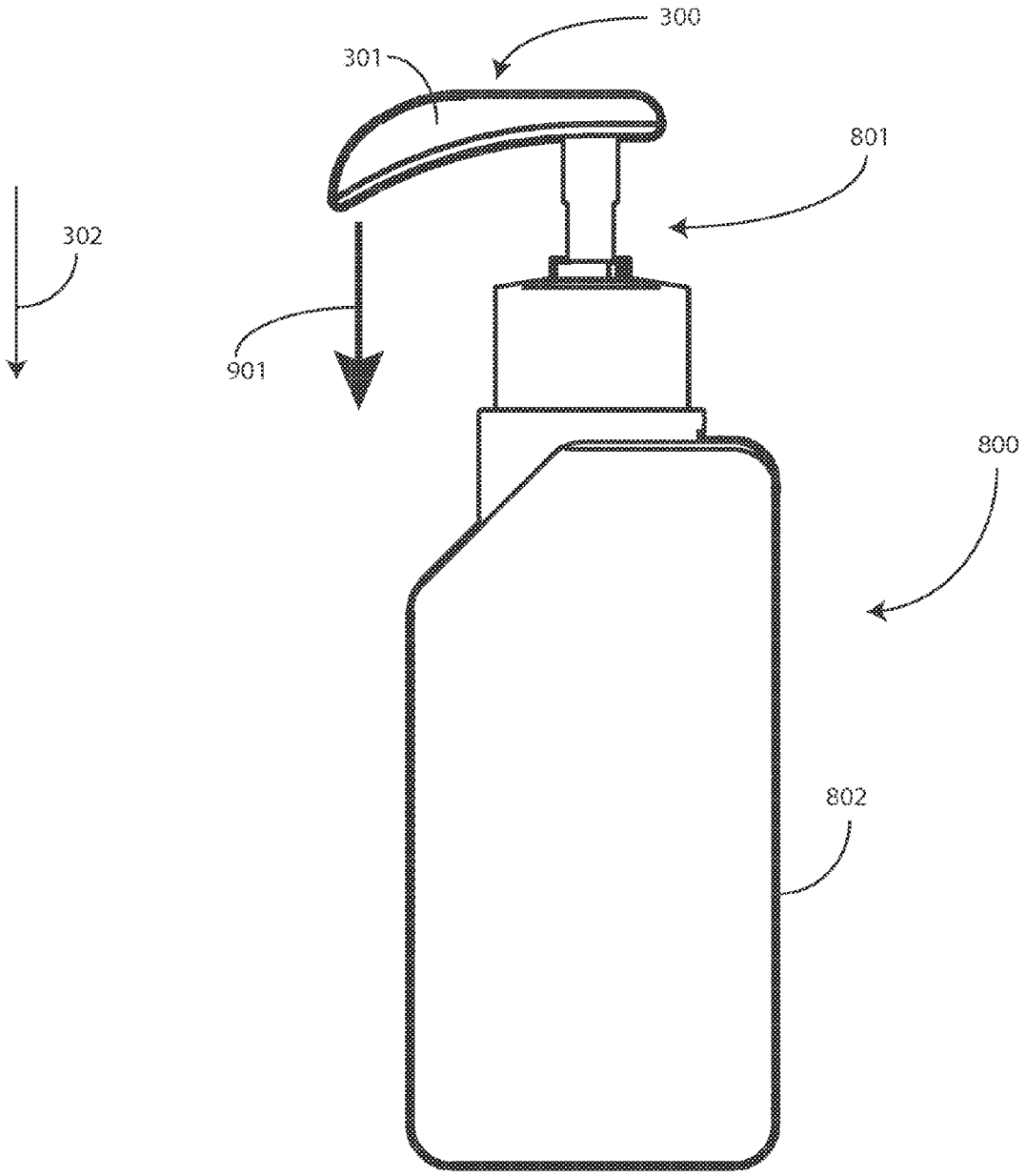
FIG. 9 illustrates one pump dispenser vessel employing a dispenser configured in accordance with embodiments of the invention.

Turning now to FIGS. 8 and 9, illustrated therein is one embodiment of a pump dispenser 800 with a pump 801 employing a dispenser 300 configured in accordance with one embodiment of the invention. The pump dispenser 800 includes a vessel 802 for holding a dispensable media, which in one embodiment is an alcoholized-gel. The vessel 802 may be manufactured from glass or thermoplastic, and may be opaque or clear. In one embodiment, the pump 801 defines a pump chamber, which is a hollow passage through which media disposed within the vessel 802 may pass.

The pump 801 is configured to dispense media 901 disposed within the vessel 802. As described with reference to FIGS. 3-7 above, in one embodiment the dispensing surface 301 of the pump 801 extends to define a scalloped dispensing surface having a concave surface on its underside. As with prior embodiments, the scalloped dispensing surface can comprise a chamber extender disposed along a ventral side of the scalloped dispensing surface that forces the dispensed media 901 to pass along the concave surface.

In the illustrative embodiment of FIGS. 8 and 9, the concave surface faces the vessel 802 and serves as a baffle for the nozzle disposed along the underside of the dispenser 300. Accordingly, dispensed media 901 exiting the vessel 802 is directed along the scalloped dispensing surface towards the vessel 802 in a ventral direction 302 relative to the dispenser 300. The baffle therefore eliminates the possibility of the media 901 being dispensed into the user's face or eyes, regardless of user hand position. This is illustrated in FIG. 10.

Figure 10:
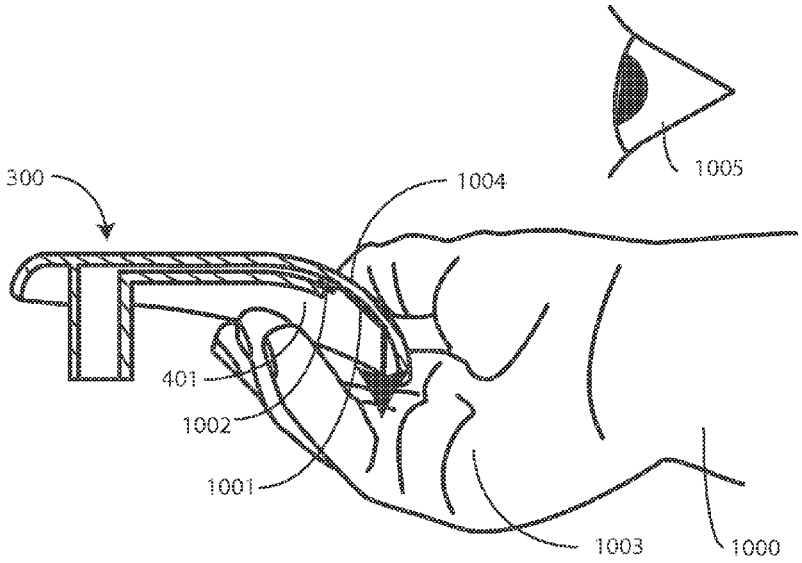
FIG. 10 illustrates one dispenser configured in accordance with embodiments of the invention while in use.
Figure 11:
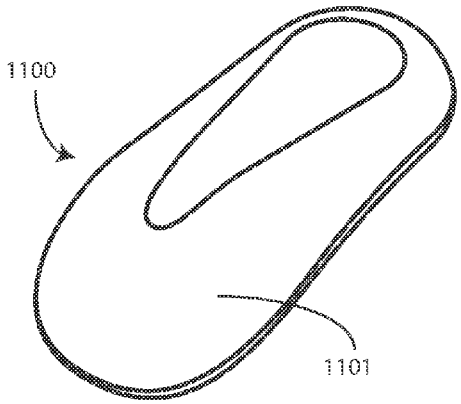
FIG. 11 illustrates one dispenser configured in accordance with embodiments of the invention.
Figure 12:
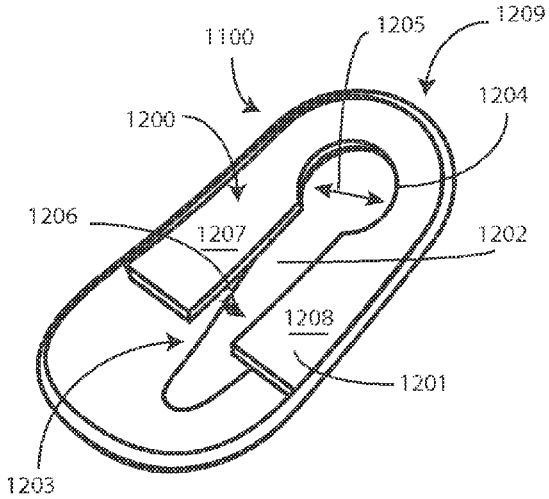
FIG. 12 illustrates one dispenser configured in accordance with embodiments of the invention.
Figure 13:
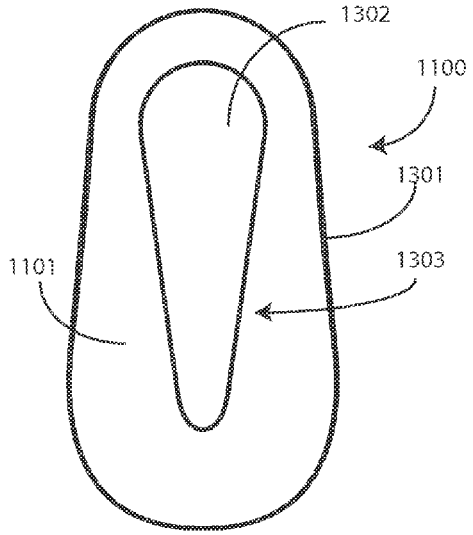
FIG. 13 illustrates one dispenser configured in accordance with embodiments of the invention.
Figure 14:
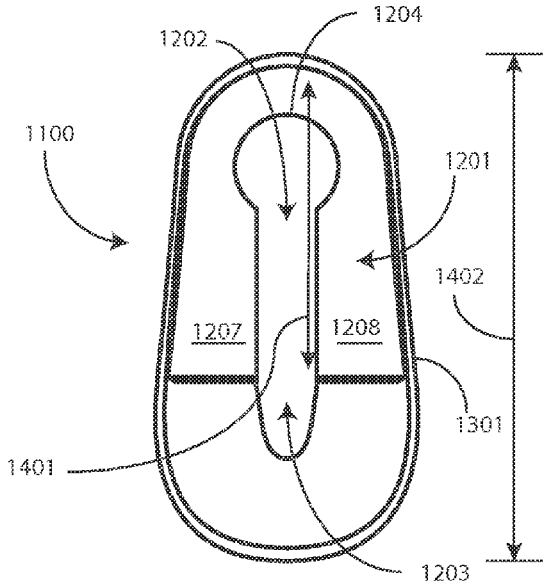
FIG. 14 illustrates one dispenser configured in accordance with embodiments of the invention.
Figure 15:
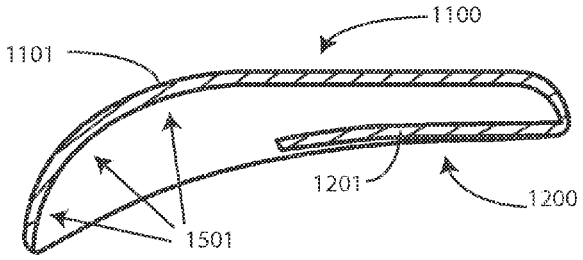
FIG. 15 illustrates one dispenser configured in accordance with embodiments of the invention.

Turning now to FIG. 10, a user 1000 is employing one embodiment of a dispenser 300 as described herein to dispense an alcoholized media 1001, such as an alcohol-based antiseptic media. The nozzle 401 has a clog 1002 due to the viscous alcoholized media 1001. The user 1000 is employing a "thumbs up" hand 1003, as previously described.

Despite the fact that the dispensation of the alcoholized media 1001 becomes extremely erratic about the clog 1002, the presence of the scalloped dispensing surface 1004 precludes the possibility of the dispensed media from reaching the user's eye 1005 by forcing the media to be ventrally dispensed. Testing has shown that this is true regardless of hand position or the user's relative position to the dispenser 300. Thus, the dispenser 300 works to solve the previously unsolved long felt need of erratic dispensation.

The inventors appreciate the fact that the dispenser 300 described above is more suited to use with an originally manufactured pump bottle. Further, the inventor appreciates that there are still many legacy pump bottles employing prior art pump tops that can be problematic when clogging. In an effort to aid owners of these prior art pumps, one or more embodiments of the invention have been configured to retrofit prior art pumps, such as the pump taught in the Houghton application. Turning now to FIGS. 11-15, illustrated therein is one embodiment of a dispenser cap 1100 configured for retrofitting an existing, prior art pump.

The dispenser cap 1100 includes many of the same features as the dispenser (300) of FIGS. 3-7, including a dispensing surface 1101 configured as an arched flange having a concave surface 1501 functioning as a baffle for dispensed media. Additionally, in one or more embodiments the dispenser cap 1100 includes a tapering contour perimeter 1301 defining a teardrop and a planar top portion 1302 defining a reverse teardrop 1303 when viewed in plan view.

To be retrofitted to existing pumps, rather than having a connector, chamber extension and nozzle, the illustrative embodiment of FIGS. 11-15 include instead a coupling mechanism 1200 that is configured to permit attachment of the dispenser cap 1100 to a prior art dispenser. The coupling mechanism 1200 in this illustrative embodiment is disposed at a first end 1209 of the dispenser cap 1100. The arching flange of the dispensing surface 1101 extends distally outward from the coupling mechanism 1200 to define the concave surface 1501 configured to redirect media dispensed from the prior art dispenser ventrally from the dispenser cap 1100 along the concave surface 1501.

In one embodiment, the coupling mechanism comprises a boot collar 1201. The boot collar 1201 is a planar member defining a passage 1202 having an opening 1203 at a first end and a circular terminus 1204 at a second end. In one embodiment, the diameter 1205 of the circular terminus 1204 is greater than the width 1206 of the passage 1202. Prior art dispensers can seat within the passage 1202, with their pump connectors seating within the circular terminus 1204.

Flanges 1207,1208 of the boot collar 1201 extend inwardly from a perimeter 1301 of the dispenser cap 1100. In the illustrative embodiment of FIGS. 11-15, the flanges 1207, 1208 and the concave surface 1501 are disposed on a common side, i.e., the ventral side, of the dispenser cap 1100. Each flange 1207,1208 has a flange length 1401 that is less than the length 1402 of the arching flange.

In one embodiment, the dispenser cap 1100 is manufactured from silicone rubber. The use of such a material offers two advantages. First, the tooling processes associated with pliable materials such as silicone permit the inclusion of large undercuts without substantially adding to the tooling costs. Accordingly, the flanges 1207,1208 can be accommodated without significantly adding to the tooling costs. Second, the use of a pliable material such as silicone allows the dispenser cap 1100 to easily pass across the prior art dispenser. The frictional surfaces offered by silicone rubber facilitate retention of the dispenser cap 1100 to the prior art dispenser.

When the prior art dispenser is placed within the passage 1203, the concave surface 1501 of the arching flange works as a baffle as previously described. Accordingly, dispensed media exiting the prior art dispenser will be directed along the concave surface 1501 ventrally away from the dispenser cap 1100. The baffle therefore eliminates the possibility of the media being dispensed into the user's face or eyes, regardless of user hand position.

In the foregoing specification, specific embodiments of the present invention have been described. However, one of ordinary skill in the art appreciates that various modifications and changes can be made without departing from the scope of the present invention as set forth in the claims below. Thus, while preferred embodiments of the invention have been illustrated and described, it is clear that the invention is not so limited. Numerous modifications, changes, variations, substitutions, and equivalents will occur to those skilled in the art without departing from the spirit and scope of the present invention as defined by the following claims. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims.

What is claimed is:

1. A dispenser cap for a dispenser, comprising:

a coupling mechanism configured to permit attachment of the dispenser cap to the dispenser; and an arching flange extending distally outward from the coupling mechanism and defining a concave surface;

the concave surface to redirect media dispensed from the dispenser ventrally from the dispenser cap along the concave surface;

the coupling mechanism comprising a boot collar; and the boot collar comprising flanges extending inwardly from a perimeter of the dispenser cap, the flanges and the concave surface disposed on a common side of the dispenser cap.

2. The dispenser cap of claim 1, the boot collar defining a passage having an opening at a first end and a circular terminus at a second end.

3. The dispenser cap of claim 2, wherein a diameter of the circular terminus is greater than a width of the passage.

4. The dispenser cap of claim 1, the flanges each having a flange length less than a arching flange length and greater than half the arching flange length.

5. The dispenser cap of claim 1, wherein the coupling mechanism is disposed at a first end of the dispenser cap, wherein a width of the dispenser cap expands along a direction extending distally from the first end.

6. The dispenser cap of claim 1, wherein the dispenser cap is constructed from silicone.

7. A dispenser, comprising:

a dispensing surface configured as an arched flange;

a connector configured for attachment to a pump chamber; and a chamber extension extending along the arched flange;

wherein dispensed media exiting the chamber extension is directed along the arched flange ventrally away from the dispensing surface;

the dispensing surface defining a teardrop plan view perimeter; and the dispensing surface defining a planar top portion configured as a reverse teardrop relative to the teardrop plan view perimeter.

8. The dispenser of claim 7, wherein the connector has a cylindrical cross section.

9. The dispenser of claim 7, the connector comprising retention mechanisms to retain the dispenser to the pump chamber.

10. The dispenser of claim 7, the connector disposed within a belly of the reverse teardrop.

11. The dispenser of claim 7, wherein the dispensing surface is between two and three inches long and between one and one-half inches wide.

12. The dispenser of claim 7, wherein the arched flange extends distally from a plane defined by a planar top portion between three-quarters and one inch.

13. The dispenser of claim 7, wherein the chamber extension passes along at least fifty percent of a length of the dispensing surface.

14. The dispenser of claim 7, further comprising:

the pump chamber; and a pump.

15. The dispenser of claim 7, chamber extension disposed along a ventral side of the arched flange.

16. The dispenser of claim 7, the dispensed media comprising alcoholized-gel.

* * * * *